US009868494B1

(12) United States Patent
Harris

(10) Patent No.: US 9,868,494 B1
(45) Date of Patent: Jan. 16, 2018

(54) SPORTSBOARD FINBOX LOCKING DEVICE

(71) Applicant: David R. Harris, El Granada, CA (US)

(72) Inventor: David R. Harris, El Granada, CA (US)

( * ) Notice: Subject to any disclaimer, the term of this patent is extended or adjusted under 35 U.S.C. 154(b) by 0 days.

(21) Appl. No.: 15/273,093

(22) Filed: Sep. 22, 2016

(51) Int. Cl.
*B63B 1/00* (2006.01)
*B63B 35/00* (2006.01)
*B63B 35/79* (2006.01)

(52) U.S. Cl.
CPC ..... *B63B 35/793* (2013.01)

(58) Field of Classification Search
CPC ... B63B 35/79; B63B 35/7926; B63B 35/793; B63B 2035/79; B63B 2035/813
USPC ..... 441/65, 74, 79
See application file for complete search history.

(56) References Cited

U.S. PATENT DOCUMENTS 4,421,492 A * 12/1983 Leva ..... B63B 35/793 114/127
5,934,963 A * 8/1999 Frizzell ..... B63B 35/793 114/138
6,691,537 B2 * 2/2004 Tan ..... B63B 35/7933 403/315
2005/0075017 A1 * 4/2005 Bistline ..... B63B 35/793 441/74
2008/0220672 A1 * 9/2008 Koelling ..... B63B 35/793 441/79
2009/0185853 A1 * 7/2009 Koelling ..... A43C 15/161 403/229
2009/0199375 A1 * 8/2009 Koelling ..... A43C 15/161 24/700
2012/0279436 A1 * 11/2012 Wood ..... B63B 35/793 114/343

* cited by examiner

*Primary Examiner* — Daniel V Venne
(74) *Attorney, Agent, or Firm* — Ray K. Shahani, Esq.

(57) ABSTRACT

A sportsboard locking device that fits into the horizontal channel of the standard finbox, the device having a housing with an internal slot, an extending flange and a lower club foot, the device further having a slider with a lever on top, the slider capable of sliding down through the inner slot of the housing and into the horizontal channel such that the lower club foot on the extending flange is locked into place within the track underneath the horizontal channel.

7 Claims, 9 Drawing Sheets

200

SPORTSBOARD FINBOX LOCKING DEVICE

FIELD OF THE INVENTION

The present invention is a method and apparatus for securing a sportsboard such as a stand-up-paddle board or surf board, using a standard padlock and cable or chain.

BACKGROUND OF THE INVENTION

Sportsboards of all types, including stand-up-paddle (SUP) boards and surf boards, body boards also known as boogie boards, kite boards, windsurfers and the like, often have one or more fin boxes located on the lower side of the sportsboard into which replaceable and/or removable fins can be placed.

The standard finbox 90 as best shown in FIGS. 4 and 5A-5C comprises a central, narrow horizontal channel 92 with one or more gaps 94 which provides access to a lower internal track 96. The typical fin 60 has a small hole on one end and a pin at the other end. The upper portion 70 of the fin 60 fits into the horizontal channel 92 and the pin drops through one of the gaps 94 in the channel 92. The fin 60 can be slid forward or backward in the horizontal channel 92 and a screw driven through the small hole and into the horizontal channel 92 can be tightened into place within the horizontal channel 92 to keep the fin 60 in a fixed position underneath the sportsboard.

FIG. 4 (prior art) shows the relative angle θ of the chamferred inner surfaces 82 of the horizontal channel 92 of the standard finbox 90 used on a sportsboard 50. By providing a slight tapering of the inner surfaces 82 of the horizontal channel 92 of the standard finbox 90, the standard fin is wedged into place and seats rigidly, without having slack or spare room for wiggling, vibrating or rattling of the fin 60 during use.

One of the problems associated with securing sportsboards of all types is connecting a padlock, chain or cable to the board in order to secure it to something less portable such as a vehicle, inside a garage or other enclosure, to a tree, to a post, furniture, a dock, etc. Other than the finbox 90, a deck plug for attaching a tether typically on the upper surface of the sportsboard, and possibly one or more small hand grips placed into the sportsboard at one or more locations, there is nothing on a typical sportsboard big enough to couple a padlock or cable to. The finbox 90 would make a convenient locking location for inserting a locking device to secure the sportsboard permanently or more safely.

U.S. Pat. No. 6,691,537 issued Feb. 17, 2014 to Tan teaches a sportsboard locking device. However, while the engaging latch 62 of the engagement member 53 terminates in a foot end 57, a back pin 64 is opposite the foot end 57. Thus, when placed into the channel groove, the front foot is effectively shorter. The smaller foot end 57 on the engagement member 53 results in a locking apparatus which is less robust, less resistant to physical strain and more prone to mechanical failure. The sportsboard locking device taught by Tan is inherently subject to greater failure than the present invention as the result of rotational and/or torsional motion.

Another SUP and surf board locking device made by DockLocks of Plant City, Fla. utilizes a cleat that is placed in the horizontal channel of the finbox and screwed into place. Then, a key having expandable jaws is inserted with the jaws placed over the cleat and the key is locked into place. A typical bicycle cable can be slipped through a cable ring on top of the jaws. www.dockslocks.com Another SUP and surf board locking device made by The Sup Lock fits into the finbox of a sportsboard. However, the apparatus requires removal of the fin prior to installation and also requires use of a special tool. http://www.thesuplock-.com

SUMMARY OF INVENTION AND ADVANTAGES

The present invention is a robust sportsboard locking device that fits inside a standard finbox and provides a mechanism for securing the sportsboard to a permanent or other safe location using typical padlocks, cables and chains.

An embodiment of the sportsboard locking device of the present invention has a housing with inner slot, extending flange and lower foot. A slider disposed within the housing is fixed in place with a pin that extends through the housing and through an oblong groove in the slider, permitting limited, vertical up and down movement of the slider within the housing.

An advantage of the present invention is that the extending flange and slider have chamferred sides that mate with the chamferred inner edges of the horizontal channel of the standard finbox so that the sportsboard locking device locks into place with essentially no rotational or torsional motion permitted.

Another advantage of the present invention is that it provides a lever for pushing the slider down firmly into the horizontal channel of the finbox so that the padlock holes through the housing portion and the slider portion can be matched up. The lever on the slider can also be used for lifting the slider up through the housing when removing the sportsboard locking device.

Benefits and features of the invention are made more apparent with the following detailed description of a presently preferred embodiment thereof in connection with the accompanying drawings, wherein like reference numerals are applied to like elements.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

Figure 1:
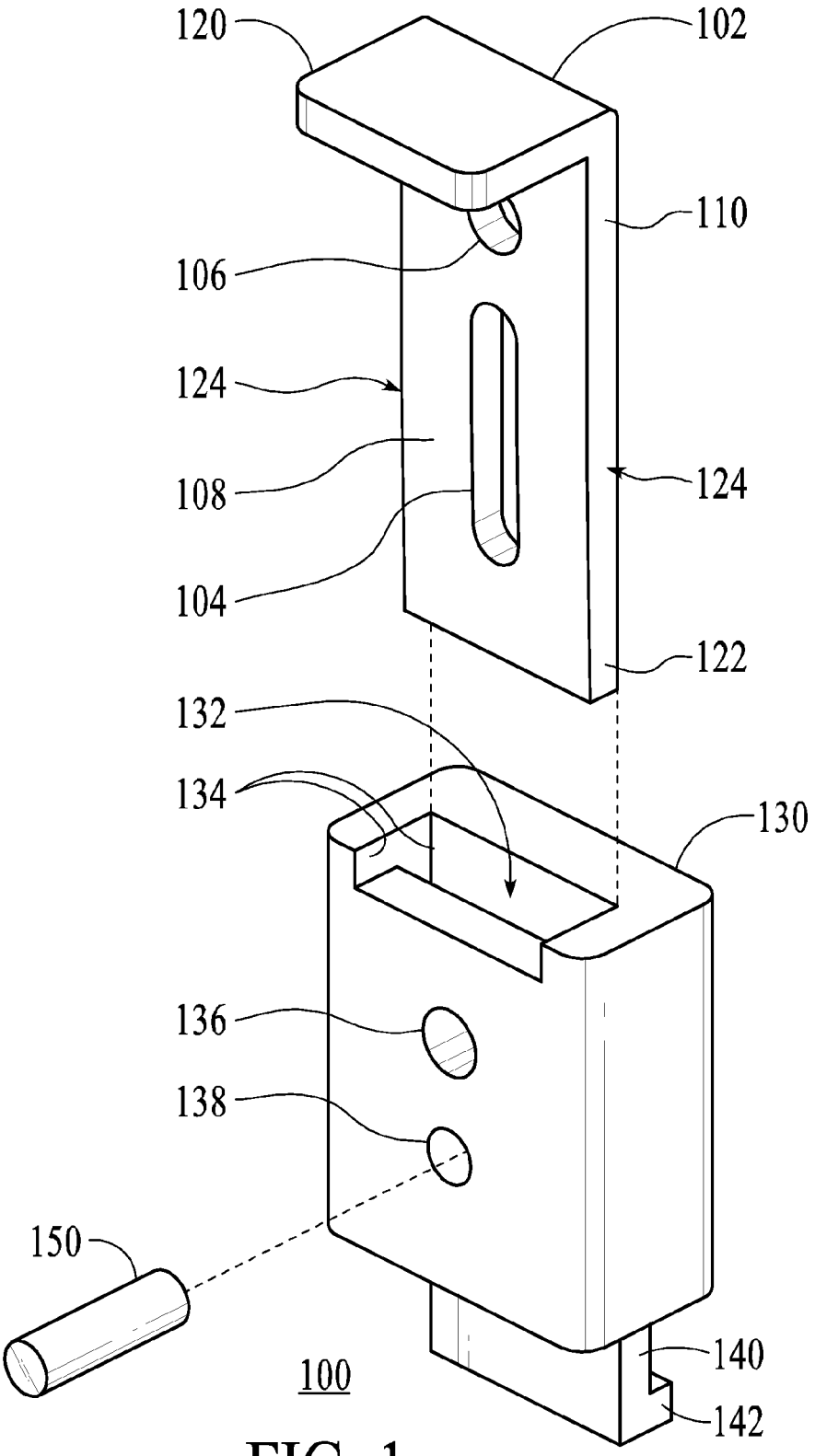
FIG. 1 is an exploded view of the sportsboard locking device of the present invention.
Figure 2:
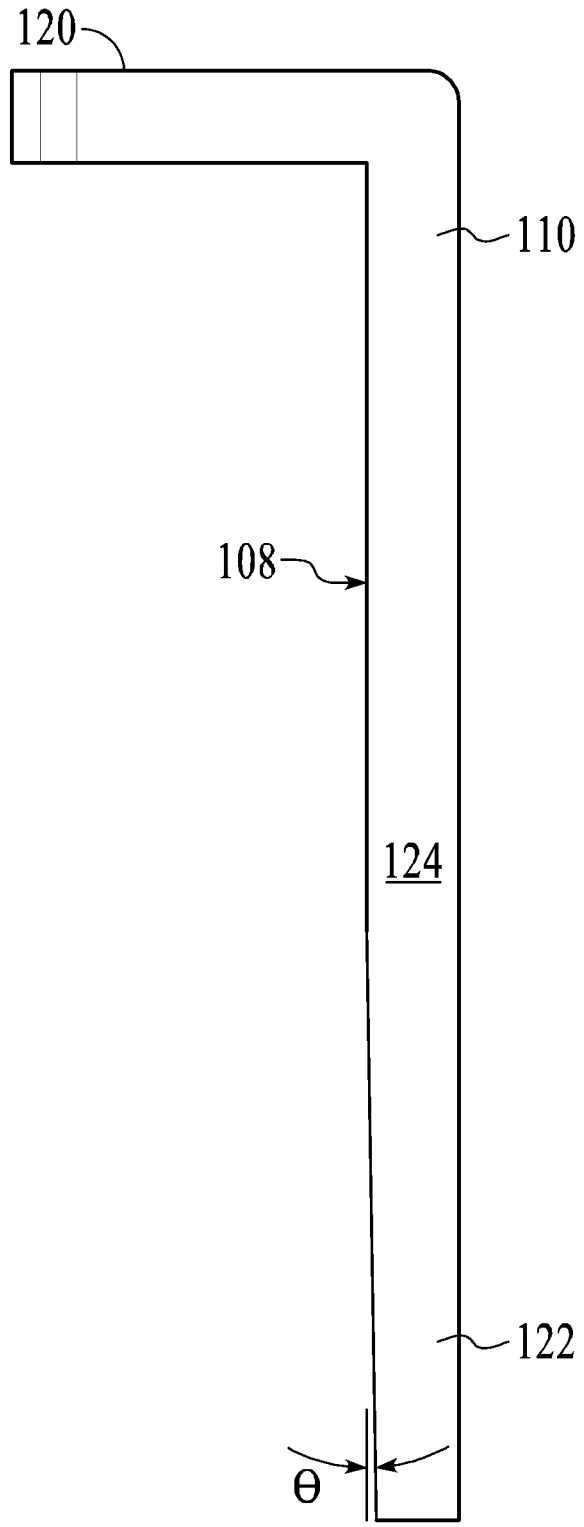
FIG. 2 is a side view of the slider member used in the sportsboard locking device of the present invention.

FIG. 1 is an exploded view of the sportsboard locking device 100 of the present invention. FIG. 2 is a side view of the slider 102 used in the sportsboard locking device 100 of the present invention. The slider 102 has a lower oblong groove 104 and an upper round shackle bore 106 on a main face 108. At the upper portion 110 of the slider 102, a lever 120 extends at an angle to the slider 102 so as to provide a mechanism for lifting the slider 102 up within the housing 130. As best shown in FIG. 2, one or both sides of the lower portion 122 of the slider 102 is tapered or chamferred at a relative angle of θ so that the slider 102 fits into the tapered internal edges 82 of the horizontal channel 92 of the standard finbox 90.

The housing 130 has a central, inner slot 132 which slidingly receives the lower portion 122 of the slider 102. The tolerances between the main face 108 and side edges 124 of the slider 102 on the one hand and the inner surfaces 134 of the inner slot 132 of the housing 130 on the other hand are minimized to preserve mechanical integrity and provide a solid, robust design. The main body of the housing 130 contains a shackle bore 136 above a lock pin bore 138. An extending flange 140 has a foot 142 which is designed to fit inside the internal track 96 underneath the horizontal channel 92 in the standard finbox 90. The self-aligning inner slot 132 of the housing 130 keeps the slider 102 aligned with the flange 140 and foot 142.

Once the lower portion 122 of the slider 102 is inserted into the inner slot 132 of the housing 130, a locking pin 150 can be inserted through the locking pin hole or holes 138 on the housing 130 and through the oblong groove 104 of the slider 102, a tight fit ensuring that the locking pin 150 stays securely inside the lock pin bore 138. Thus, with the lock pin 150 secured in place, the slider 102 can be lifted up and pushed down inside the inner slot 132 of the housing 130 with the lock pin 150 extending through the oblong groove 104.

Figure 3:
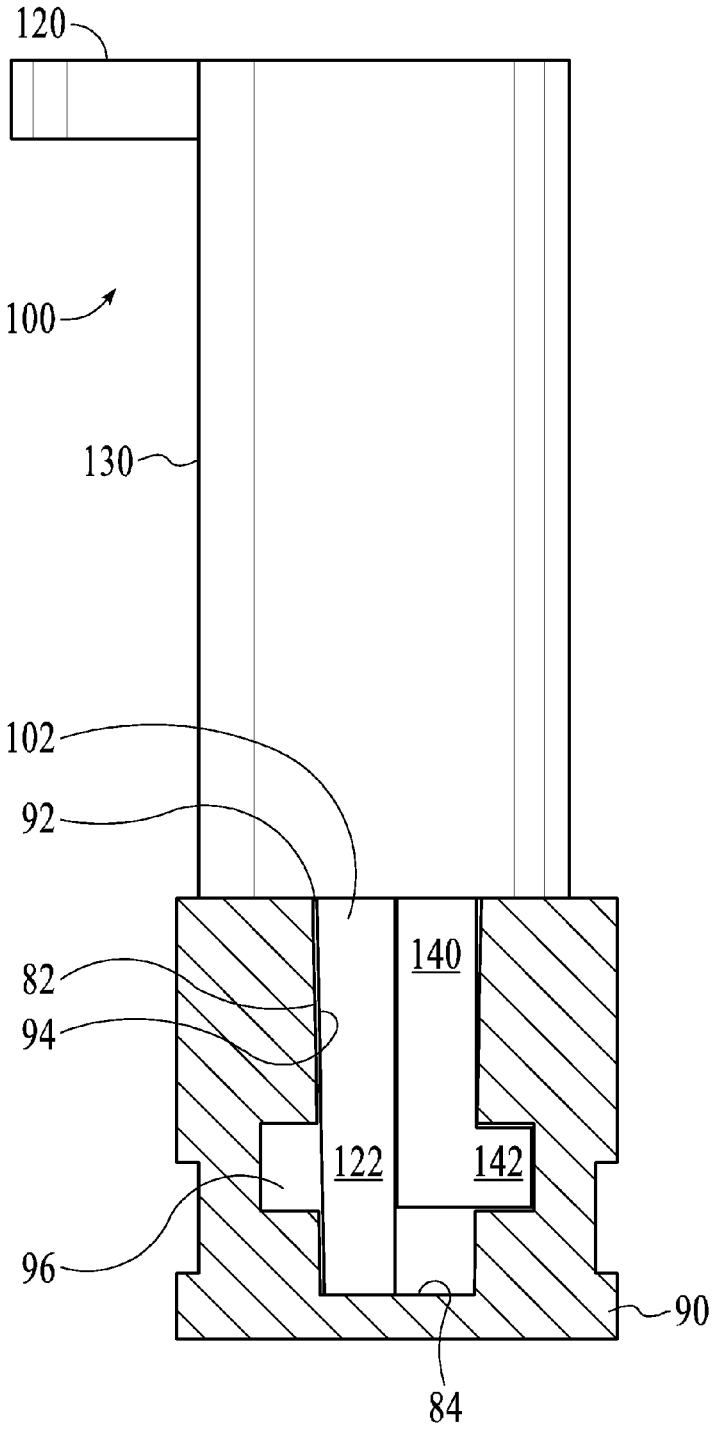
FIG. 3 is a side view of the sportsboard locking device of the present invention installed inside the horizontal channel of a sportsboard finbox (shown in section).
Figure 4:
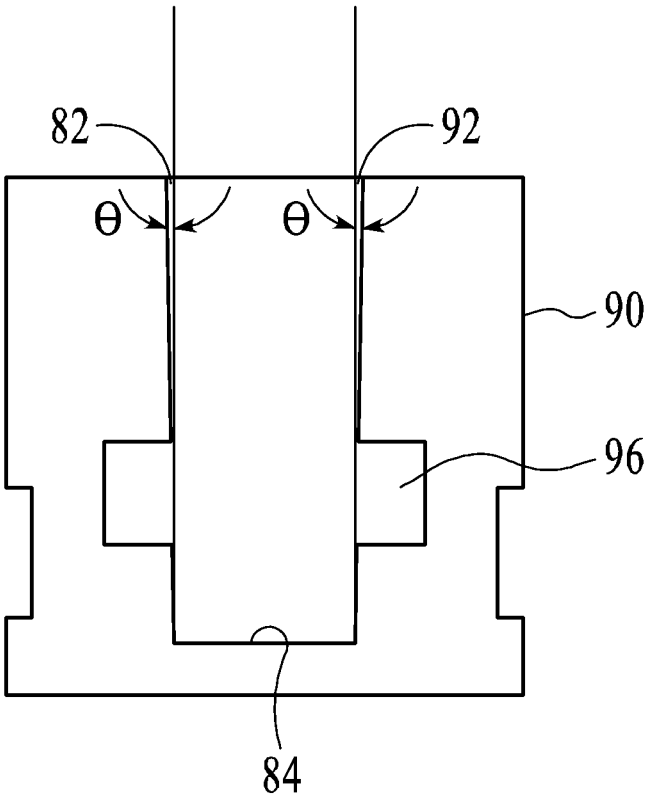
FIG. 4 (PRIOR ART)
FIG. 4 (prior art) shows the relative angle of the chamferred inner surfaces of the horizontal channel of the standard finbox used on a sportsboard.

FIG. 3 is a side view of the sportsboard locking device 100 of the present invention installed inside the horizontal channel 92 of a sportsboard finbox 90 (shown in section). As shown, the housing 130 of the sportsboard locking device 100 rests on top of the horizontal channel 92 of a sportsboard finbox 90. The extending flange 140 and lower foot 142 are positioned inside the horizontal channel 92 and inner track 96, respectively. When the lever 120 is depressed, the chamferred lower portion 122 of the main face or faces 108 of the of the slider 102 is wedged all the way down to the bottom 84 of the horizontal channel 92. The secure, tight fit between the chamferred, lower portion 122 of the slider 102, the bottom 84 and side edges 82 of the horizontal channel 92, and the extending flange 140 and lower foot 142 within the inner track 96 of the horizontal channel 92 provide a rigid, unitary assembly providing unparalleled security for a sportsboard 50.

Figure 5A:
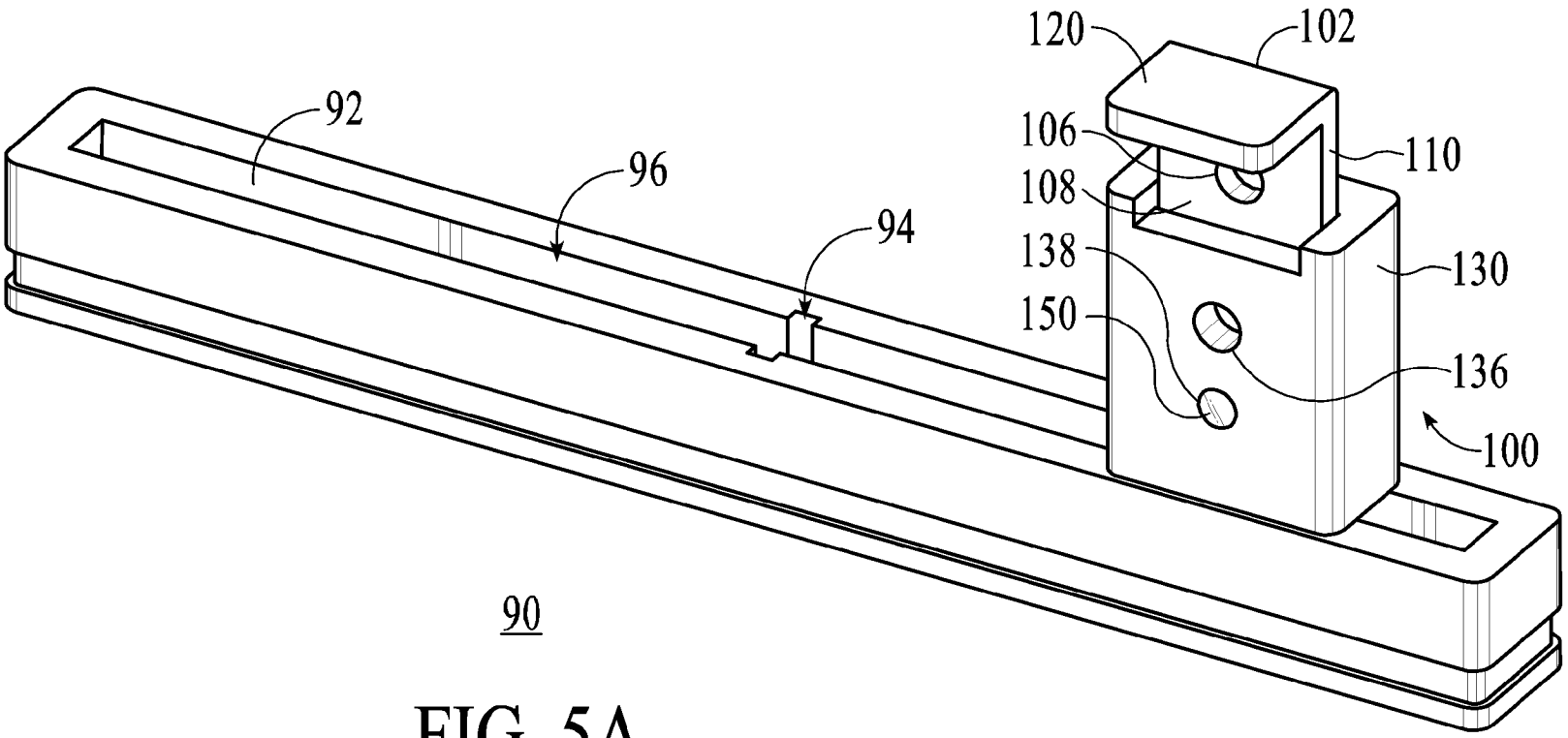
FIG. 5A shows the sportsboard locking device of the present invention in the unlocked position positioned on top of the horizontal channel of the standard finbox used on a sportsboard.
Figure 5B:
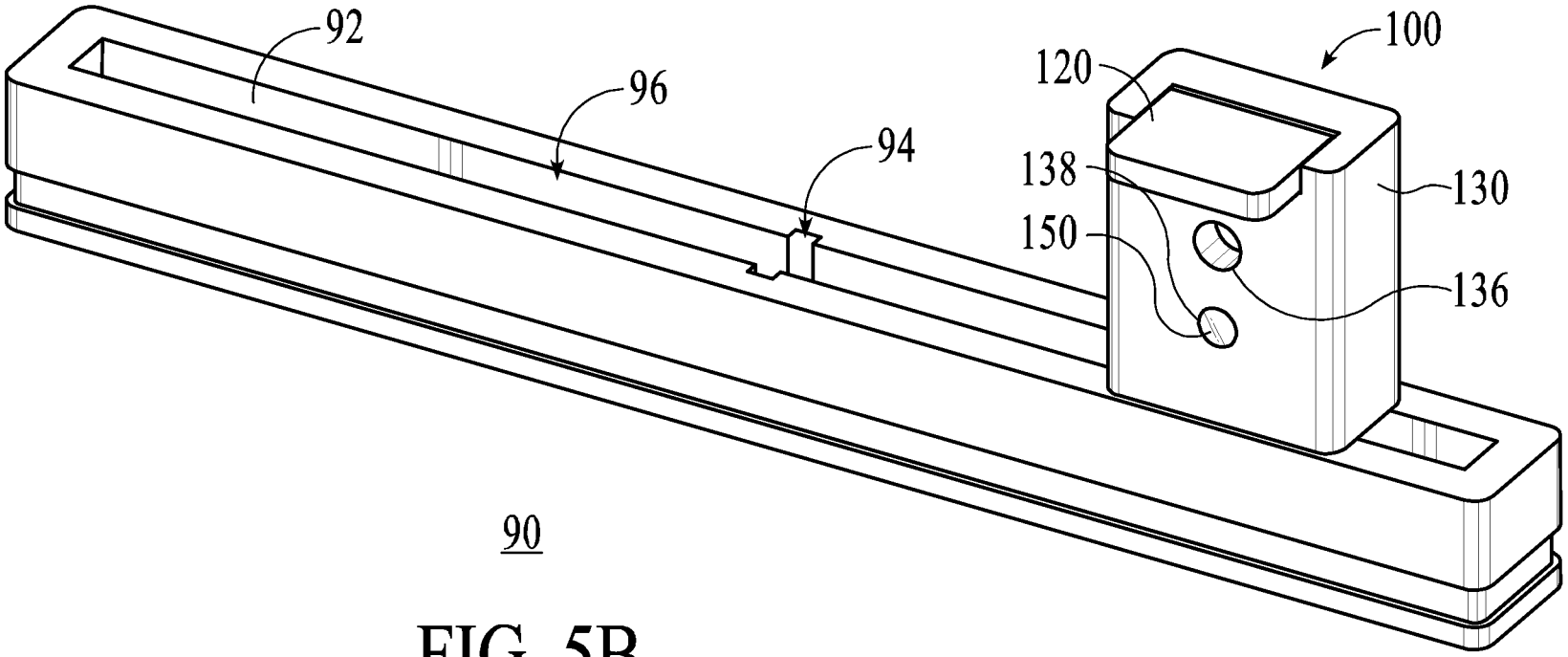
FIG. 5B shows the sportsboard locking device of the present invention in the locked position positioned on top of the horizontal channel of the finbox used on a sportsboard.
Figure 5C:
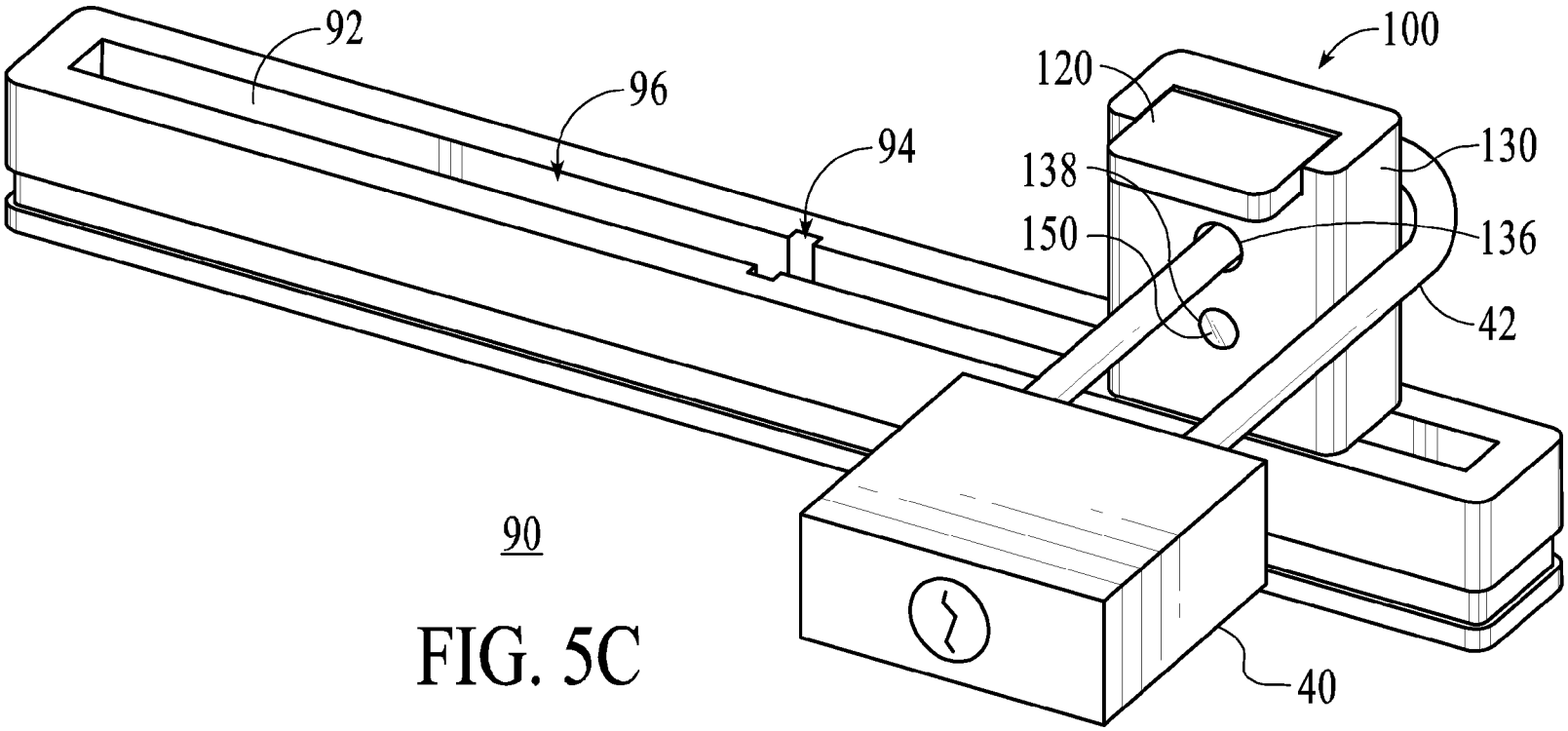
FIG. 5C shows a padlock attached to the sportsboard locking device of the present invention in the locked position positioned on top of the horizontal channel of the finbox used on a sportsboard.

FIGS. 5A-C show the sportsboard locking device 100 of the present invention in unlocked, locked and padlock shackled positions, respectively, positioned on top of the horizontal channel 92 of the standard finbox 90 used on a sportsboard 50. As described above, when the sportsboard locking device 100 is placed into the channel 92 the lever 120 on the slider 102 must be lifted up. This permits the extending flange 140 to slide down through the horizontal channel 92 so that the lower foot 142 can be shifted to the side into the inner track 96. Then, when the lever 120 is depressed and the lower portion 122 of the slider 102 slides all the way down to the bottom 84 of the inner track 96, the shackle bores 136 on the housing 130 align with the shackle bore 106 on the slider 102. Finally, when the shackle bores 136 on the housing 130 align with the shackle bore 106 on the slider 102, the shackle arm 42 of a padlock 40 can fit through all three bores and the padlock can be secured to a cable, chain, etc.

Figure 5D:
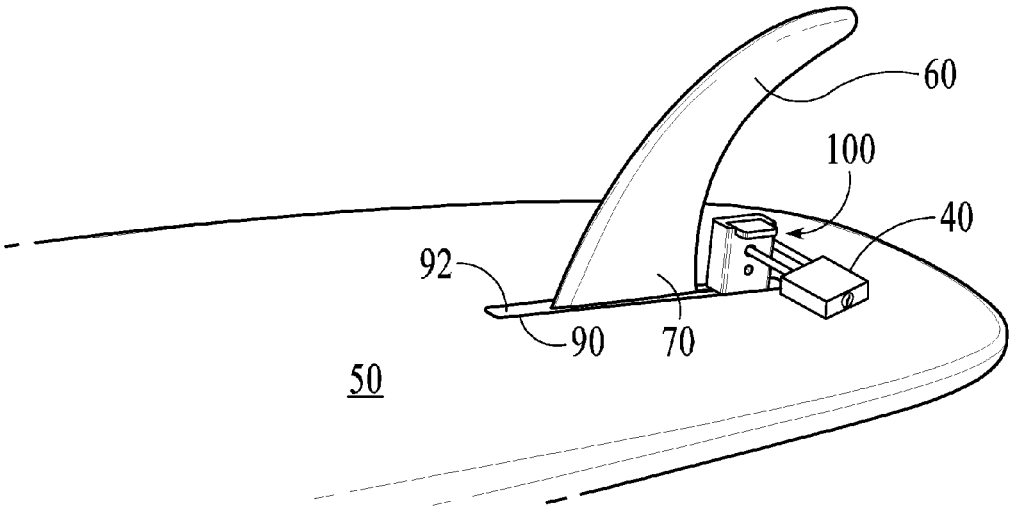
FIG. 5D shows a padlock attached to the sportsboard locking device of the present invention in the locked position positioned on top of the horizontal channel of the finbox used on a sportsboard with a fin in place in the channel of the finbox.
Figure 5E:
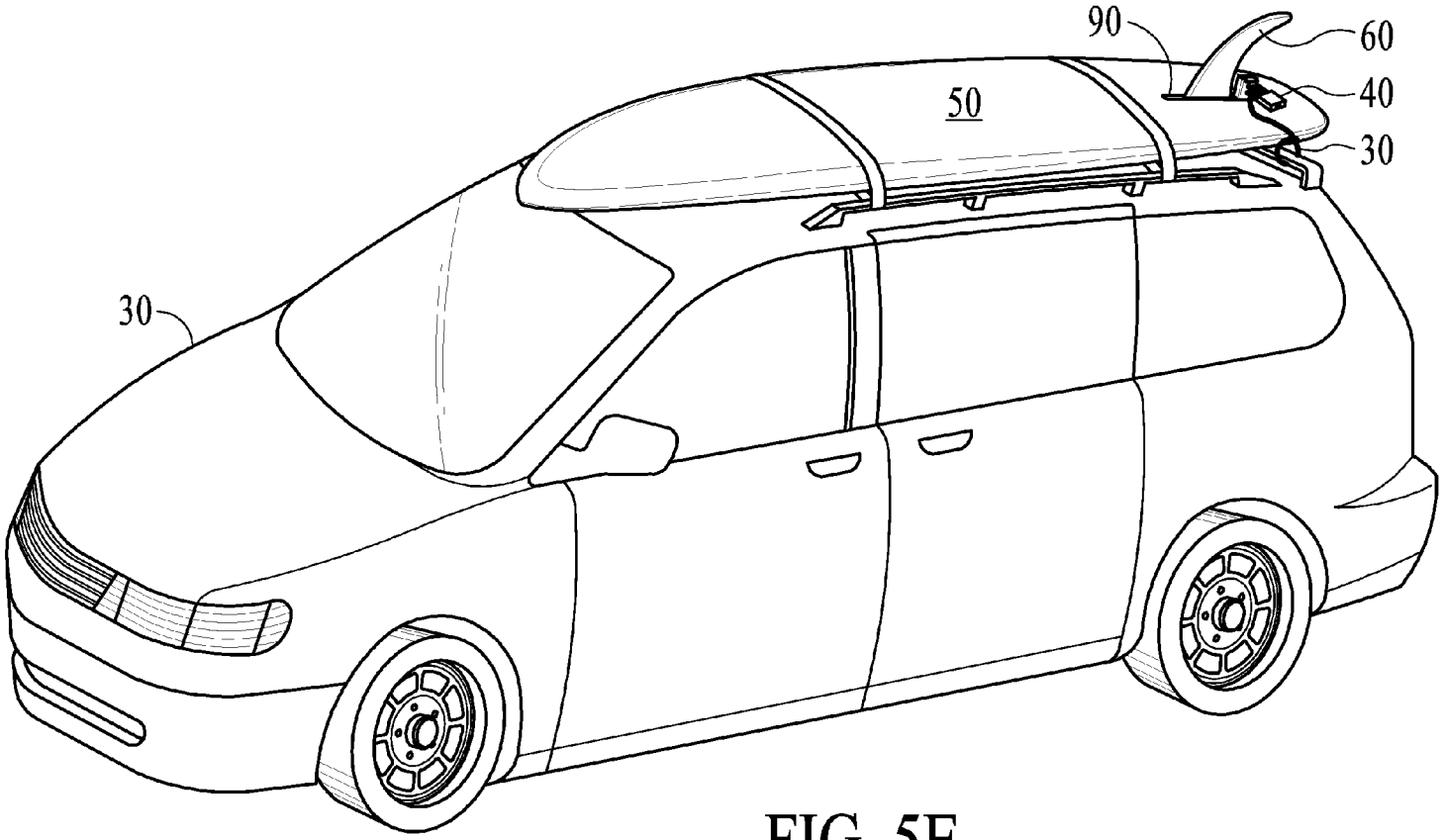
FIG. 5E shows a padlock attached to the sportsboard locking device of the present invention attached to a sportsboard with a cable and secured to an automobile.

FIG. 5D shows a padlock 500 attached to the sportsboard locking device 100 of the present used on a sportsboard 50 with a fin in place in the channel 92 of the finbox 90. FIG. 5E shows the sportsboard locking device 100 attached to a sportsboard 50 with a cable 30 and secured to an automobile 30. As described above, the sportsboard locking device 100 can be used with the fin 60 in place on the sportsboard 50. The upper edge 70 of the fin 60 fits inside the horizontal channel 92 of the finbox 90. Once the shackle arm 42 of the padlock 40 has been placed through the shackles bores 136 of the housing 130 and the shackle bore 106 of the slider 102, a cable 30 can be placed over the shackle arm 42 and the padlock 40 can be locked. It will be understood that while the sportsboard locking device 100 is shown securing a sportsboard 50 to an automobile 30, it will be understood that the sportsboard locking device 100 can also be used to lock a sportsboard 50 to any other object or structure, permanent or otherwise.

As discussed above, the fin 60 likely has a screw or nut for securing the fin 60 into place in the finbox 90. Regardless of whether the screw is in front of the fin 60 or behind the fin 60, the sportsboard locking device 100 can be positioned so as to prevent removal and/or theft of the fin 60. As an example, if the fin 60 is positioned almost all the way to the rear of the sportsboard 50, the sportsboard locking device 100 can be positioned inside the finbox 90 at the very back end of the finbox 90, i.e., at the rear end of the sportsboard 50. The screw that holds the fin 60 in place in the finbox 90 would be essentially underneath the main body portions 102 of the sportsboard locking device 100 and therefore could not be accessed.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A sportsboard locking device that fits inside a horizontal channel of a finbox mounted on a sportsboard, the sportsboard locking device comprising:

a housing having an inner slot defined by a plurality of inner surfaces, a shackle bore extending through the housing, a lock pin bore extending through the housing, a flange extending from a bottom of the housing with a lower foot projecting from the flange at an angle to the flange;

a slider having an upper portion, a main face and a lower portion, the slider having a shackle bore extending through the upper portion, the slider having an oblong groove disposed on the main face, the slider having a lever adjacent the upper portion, and the slider having a chamferred lower portion; and a lock pin that is fixed in place in the lock pin bore on the housing, the lock pin passing through the housing and into the oblong groove on the slider, wherein the slider can be lifted by the lever to allow the lower foot to be inserted into the finbox of a sportsboard and when the slider is depressed the chamferred lower portion seats into a horizontal channel of the finbox such that the lower foot prevents removal of the sportsboard locking device from the finbox.

2. The sportsboard locking device of claim 1 in which the housing is rectangular shaped.

3. The sportsboard locking device of claim 1 in which the inner slot of the housing and the slider are both rectangular shaped.

4. The sportsboard locking device of claim 1 formed using material selected from a group of materials consisting of regular and hardened metal, polymeric material including plastic and rubber, fiberglass, resin-based material, composite, injection-molding substrate.

5. The sportsboard locking device of claim 1 further comprising a locking shackle with a shackle arm that fits through the shackle bore of the housing and the shackle bore of the slider.

6. The sportsboard locking device of claim 1 in which the locking shackle is a padlock.

7. The sportsboard locking device of claim 1 further comprising a flexible connector selected from a group of flexible connectors consisting of cables and chains.

* * * * *